United States Patent [19]

Barker, III

[11] 4,266,092

[45] * May 5, 1981

[54] LOUDSPEAKER SYSTEM WITH BROAD IMAGE SOURCE

[75] Inventor: Charles R. Barker, III, Harvard, Mass.

[73] Assignee: Bose Products, Inc., Toa Baja, P.R.

[ * ] Notice: The portion of the term of this patent subsequent to Jan. 9, 1996, has been disclaimed.

[21] Appl. No.: 957,423

[22] Filed: Nov. 2, 1978

Related U.S. Application Data

[63] Continuation of Ser. No. 762,017, Jan. 24, 1977, Pat. No. 4,133,975, which is a continuation of Ser. No. 564,543, Apr. 2, 1975, abandoned.

[51] Int. Cl.[3] ..... H04R 1/28

[52] U.S. Cl. ..... 179/1 E; 179/1 G; 181/144; 181/148

[58] Field of Search ..... 179/1 D, 1 E, 1 G, 1 GA, 179/146 E; 181/143–156

[56] References Cited

U.S. PATENT DOCUMENTS

| | | | |
|---|---|---|---|
| 3,153,120 | 10/1964 | Brown | 179/1 G |
| 3,670,842 | 6/1972 | Ekbahl | 179/1 E |
| 3,727,004 | 4/1973 | Bosie | 179/1 E |
| 3,759,345 | 9/1973 | Borisenko | 179/1 GA |
| 3,845,246 | 10/1974 | Ouvrier | 179/1 E |
| 3,983,333 | 9/1976 | Allison | 179/1 E |
| 4,031,318 | 6/1977 | Pitrie | 179/1 D |
| 4,051,919 | 10/1977 | Buettner | 179/1 E |

FOREIGN PATENT DOCUMENTS

| | | | |
|---|---|---|---|
| 1160894 | 1/1964 | Fed. Rep. of Germany | 179/1 G |

*Primary Examiner*—Gerald L. Brigance
*Attorney, Agent, or Firm*—Charles Hieken

[57] ABSTRACT

A loudspeaker system comprises a woofer in a front panel, a midrange driver facing to the front and a tweeter in a corner panel separated from the midrange driver by the woofer and pointing to the front and side with a crossover network arranged to energize at least the midrange and tweeter in an overlapping frequency range. An adjustable deflector is positioned near the tweeter. Another embodiment of the invention has only a woofer and a tweeter on only one corner panel with the crossover network arranged to energize the two in a common frequency range that is greater than an octave.

11 Claims, 8 Drawing Figures

LOUDSPEAKER SYSTEM WITH BROAD IMAGE SOURCE

This is a continuation of application Ser. No. 762,017, filed Jan. 24, 1977, now U.S. Pat. No. 4,133,975 which is a continuation of abandoned application Ser. No. 564,543, filed Apr. 2, 1975, now abandoned.

BACKGROUND OF THE INVENTION

The present invention relates in general to loudspeaker systems and more particularly concerns novel apparatus and techniques for providing an inexpensive bookshelf loudspeaker with few placement constraints that is relatively inexpensive to manufacture while offering uinque spatial properties.

The internationally known BOSE 901 loudspeaker system embodies principles for simulating in the home sound of the character heard in the concert hall. For optimum results the BOSE 901 loudspeaker is located about a foot from a wall facing angled speaker panels to provide a good balance of reflected and direct sound with a substantially uniform radiated power response in cooperation with an electronic active equalization network. While performance of this system is excellent, there are a number of home listening locations where placement for optimum performance is difficult.

Accordingly, it is an important object of this invention to provide a bookshelf loudspeaker having few placement constraints offering unique spatial properties while being relatively inexpensive to manufacture.

It is another object of the invention to achieve the preceding objects with a relatively compact system.

It is still a further object of the invention to achieve one or more of the preceding objects while providing a good balance of direct and reflected sound and presenting a broad acoustical image source that is interesting to the listener.

SUMMARY OF THE INVENTION

According to the invention, there is a loudspeaker cabinet having a first panel for supporting a first driver means, and at least a second panel for supporting second driver means that faces to the front and side, first driver means mounted on the first panel for radiating acoustical energy in a first frequency range, second driver means supported on the second panel for radiating energy in a second frequency range that includes portions higher than the first frequency range and a common frequency range that overlaps the first frequency range for at least a half octave and crossover network means for coupling electrical energy from an input terminal pair to the first driver means and the second driver means so that the first driver means radiates energy over said first frequency range and the second driver means raidates energy over said second frequency range.

According to another aspect of the invention there is adjustable deflector means intercepting the energy radiated by the second driver means for directing the high frequency energy radiated therefrom in a predetermined direction. According to a specific aspect of the invention there is at least a third panel for supporting third driver means between the first and second panels, and third driver means supported on the third panel.

Numerous other features, objects and advantages of the invention will become apparent from the following specification when read in connection with the accompanying drawing in which:

DETAILED DESCRIPTION OF PREFERRED EMBODIMENTS

Figure 1:
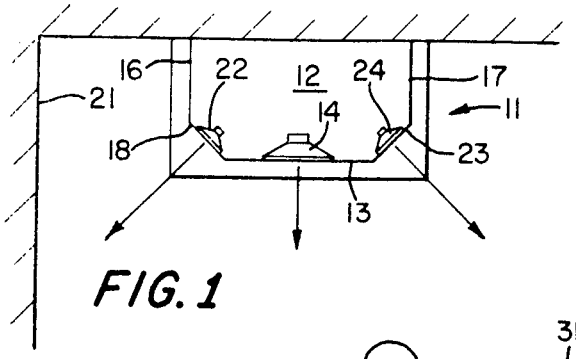
FIG. 1 is a top view of an embodiment of the invention in a room.
Figure 2:
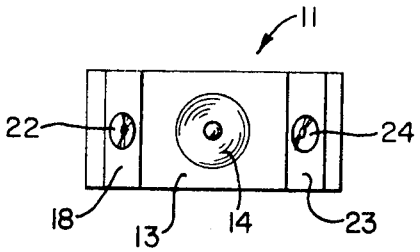
FIG. 2 is a front view of the embodiment of FIG. 1.

With reference now to the drawing and more particularly FIG. 1 thereof, there is shown a top view of a loudspeaker system according to the invention in a room. The loudspeaker cabinet 11 includes a top 12, a front panel 13 supporting a woofer 14, side panels 16 and 17, a corner panel 18 facing the side wall 21 and carrying a tweeter 22 and a corner panel 23 facing toward the center of the room and carrying a midrange driver 24. FIG. 2 is a front view of loudspeaker system 11. The listener 25 receives some direct sound from midrange driver 24 and reflected sound from tweeter 22.

In this embodiment low frequency woofer 14 typically radiates between 40 Hz and a first break frequency by itself and between the first break frequency and a second break frequency with midrange driver 24. Midrange driver 24 radiates between the first break frequency and a third break frequency. Tweeter 22 radiates between the second break frequency and 18 kHz. Drivers 22 and 24 have an overlapping range between 3 kHz and 7 kHz. The first break frequency is typically within the range of 500 to 1000 Hz; the second, between 2 kHz and 3 kHz; and the third between 6 kHz and 9 kHz. A loudspeaker thus arranged produces a very wide diffused acoustical spatial image, especially noticeable in stereo with both tweeters 22 facing the adjacent sidewall. By arranging loudspeaker system 11 as shown, the embodiment in FIG. 2 may be flipped over so that the top 12 is on the bottom and thereby tweeter 22 will be to the right of woofer 14 as seen by listener 25.

The invention is believed to produce this widely diffused spatial image by taking advantage of some known factors. It is known that humans receive much auditory localization information from the high frequency components of sound having spectral components above 1 kHz. The invention takes advantage of this characteristic in a number of ways. The very high frequency components radiate toward the sidewall away from the listener, and the reflections from the side wall create a virtual image of the tweeter on the other side of the wall spaced from the sidewall by the same distance between the sidewall and the tweeter 22. To create a reasonably well localized virtual image, tweeter 22 is reasonably directional as distinguished from the omnidirectional tweeters usually used in conventional loudspeaker systems. A small amount of high frequency components are radiated directly at the listener 25 by the midrange driver 24. It was discovered that failing to provide this direct high frequency component would cause an instrument to tend to sound far away and smeared whereas providing this direct component maintained a proper cripsness to instruments.

It is known in psycoacoustics (Gardner, Journal of the Acoustical Society of America, Vol. 46, No. 2 1969) that several things can be done to effect the fusion of a sonic image. By having two sources that are physically separated and radiate overlapping portions of the spectrum, it is possible to produce the impression of a single broad source located between them. It is also known that by taking two separated loudspeakers and arranging to radiate signals from them in phase opposition while adjusting the amplitude of one of the loudspeakers, it is possible to create phantom sources that lie outside of the region between the two sources.

Figure 6:
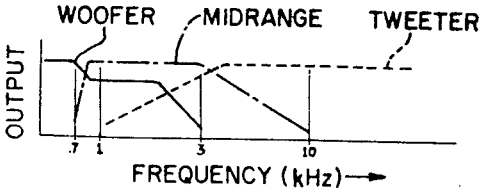
FIG. 6 illustrates the frequency ranges of the woofer, midrange driver and tweeter in the embodiment of FIGS. 1 and 2.

The invention takes advantage of these characteristics by having the transition between the two drivers 22 and 24 of gentle slope as shown in FIG. 6 with considerable overlap in the crossover region where both drivers radiate spectral components in this common region. By proper selection of the midrange driver 24 and the tweeter 22, it is possible to achieve two 180° phase shifts at relatively narrow bands of frequencies in the common frequency range where drivers 22 and 24 radiate in phase opposition in the regions about the fundamental resonances of the drivers. Drivers 22 and 24 each typically have a fundamental resonance in the common frequency range, that of tweeter 22 being higher than that of midrange driver 24 to effect these phase shifts. Although these phase shifts may produce a desirable effect, there is presently insufficient evidence to positively confirm it .

By having spatially separate sound sources radiating, the apparent location of the sound moves from one side to the other with spectrum of the radiated signal. Since music generally contains a broadband signal, the apparent source is constantly apparently in motion to the listener, and the listener is unable to localize the sound as coming from any one point but perceives the sound as coming from a broad source. The combination of these effects produces a loudspeaker with a wide spatial image.

Figure 3:
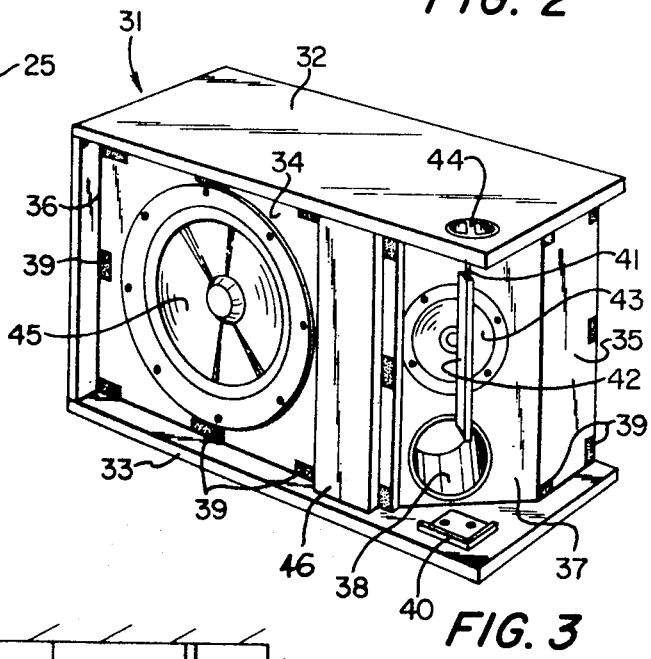
FIG. 3 is a perspective view of an embodiment of the invention using only two drivers for each loudspeaker cabinet.

Referring to FIG. 3, there is shown a perspective view of another embodiment of the invention that uses only two drivers while being relatively easy to locate, having superior spatial properties relative to a conventional loudspeaker and being adjustable to the taste of the listener for room and source characteristics. FIG. 3 shows a right-cornered loudspeaker system 31 having rectangular top and bottom panels 32 and 33, a rectangular front panel 34 side panels 35 and 36, a rear rectangular panel (not visible in FIG. 3) and an angled corner panel 37 formed with a port 38. Woofer 45 is mounted in front panel 34. A vertical shaft 41 split at the bottom depends from the corner of top panel 32 and carries a sound deflecting panel or vane 42 facing tweeter 43 mounted in corner panel 37. A knob 44 attached to vertical shaft 41 controls the orientation of sound panel 42 for adjustment to control the energy radiated directly to the listener. Deflecting panel 42 pivots about an axis near its front edge so that movement of the rear edge toward and from the woofer deflects less and more energy, respectively, toward the center of the room.

Velcro tabs, such as 39, are attached to the front and side panels for mating engagement with Velcro tabs on grill cloth assemblies (not shown). One nearly squar grill cloth assembly covers woofer 45. A two-panel hinged assembly bears against corner plate 40 and covers the tweeter corner and side. A finished vertical wooden slat 46 separates the two assemblies.

Figure 4:
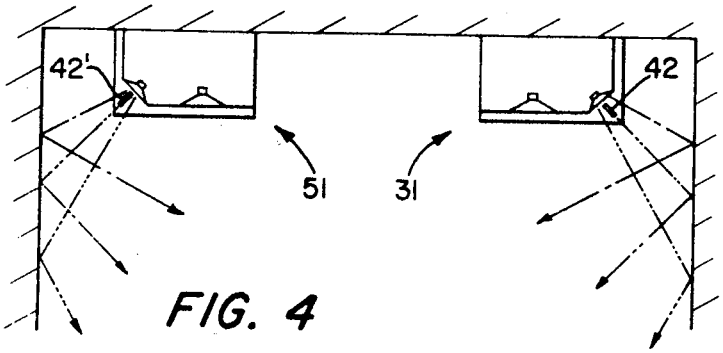
FIG. 4 is a plan view of a pair of loudspeakers according to the invention in a room arranged for stereo.

Referring to FIG. 4, there is shown a plan view of right loudspeaker system 31 and a left loudspeaker system 51 that is the mirror image of right loudspeaker system 31. A feature of the invention is that each woofer typically operates over the frequency range from 30 Hz to 3.0 kHz while each tweeter typically operates over a range of 1.2 to 18 kHz so that the overlapping or common frequency range is of the order of 1.8 kHz and preferably an octave or more but no less than a half octave. It was discovered that a common frequency range as low as ⅓ octave resulted in sounds from the same instrument appearing to come from different locations while a common frequency range preferably at least an octave avoided the problem. A common frequency range of a half octave may be acceptable but a greater range is preferred.

Another feature of the invention is that tweeter 43 is highly directional, unlike conventional loudspeaker systems which feature omnidirectional tweeters. The directional tweeter facilitates exercising good control over where the energy from the tweeter is directed with the deflecting panel 42. FIG. 4 shows the normal position of deflecting panesl 42 and 42' with the plane of each along the tweeter axis. In this position the listener perceives a reasonably wide image extending somewhat into the center region between the loudspeaker systems when used in stereo. By moving the rear edges of deflecting panels 42 and 42' further away from the woofer, more high frequency energy is deflected toward the center of the room to enhance the center image. The image perceived is then less spatious than in the normal position and sounds more intimate. This position may be advantageous when listening to a vocalist or single instrument.

By moving the rear edges of deflecting panels 42 and 42' toward the woofer, more high frequency energy is directed away from the listener and back toward the rear and sidewalls to create a very spacious sound image with less center image between the loudspeaker systems. This position may be useful when the loudspeaker systems are positioned very close to each other, such as in a small room.

It is preferred that the deflecting panels 42 and 42' be arranged so that as a deflecting panel is rotated, it is possible to redirect as much energy from the tweeter as possible, it should function at as low a frequency as practical, it should not hornload the tweeter and rotation of the deflecting panels should not change the radiated power frequency response of the loudspeaker system, this response being substantially constant. The deflecting panel should be massive and stiff enough so that it reflects at the frequencies of interest and its length, and width preferably are larger than a wavelength at these frequencies. These frequencies are typically above 3 kHz, typically the second crossover frequency. The rear edge preferably is very close to tweeter 43.

Figure 5:
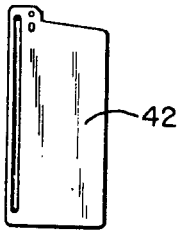
FIG. 5 is a plan view of a preferred form of a deflector panel according to the invention.

Referring to FIG. 5, there is shown a plan view of a preferred form of deflecting panel which meets these criteria made of 0.025" thick black anodized or chromated high strength aluminum. It may be advantageous to place sound absorbing material on the side of the deflecting panel that faces the tweeter when the rear edge of the deflecting panel is pointed away from the woofer because there is then less high frequency absorption compared with other positions when there is substantial reflection from the walls allowing coverings and other objects to absorb.

Figure 7:
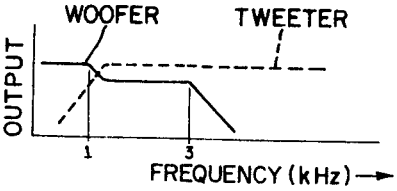
FIG. 7 illustrates the frequency ranges of the woofer and tweeter in the embodiment of FIG. 3.

Referring to FIGS. 6 and 7 there are shown graphical representations of typical loudspeaker driver responses with the system according to the invention in the embodiments of FIGS. 1 and 3, respectively. The transition network comprises means for intercoupling the input terminal pair and the loudspeaker driver means for providing spectral components in a common frequency range to first and second ones of the loudspeaker driver means and coacting therewith to comprise means for attenuating spectral components radiated by the first and second loudspeaker driver means above and below respectively first and second frequencies respectively at the high and low ends respectively of the common frequency range relative to spectral components applied thereto in the common frequency range. For the embodiment of FIG. 3 this common frequency range is between 1 and 3 kHz with the first driver being woofer 45 and the second driver being tweeter 43 and the first and second frequencies being substantially 3 and 1 kHz, respectively. For the embodiment of FIGS. 1 and 2, there is a common frequency range and first and second frequencies between the woofer and midrange driver, between the midrange driver and the tweeter and between the woofer and tweeter as seen in FIG. 6. The transition network thus comprises means for establishing the transition between the first and second drivers of gentle slope in the common frequency range so that the difference in gain between the first driver output and second driver output is substantially uniform over the common frequency range.

Figure 8:
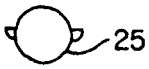
FIG. 8 is a schematic circuit diagram of a loudspeaker system for the embodiment of FIG. 3.
Figure 8:
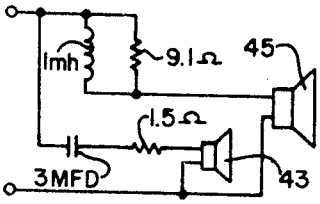

Referring to FIG. 8 there is shown a schematic circuit diagram of a preferred transition network for use with the loudspeaker system of FIG. 3 in which woofer 45 is an 8" woofer having a d-c impedance of 5.7 ohms, tweeter 43 is a three inch electrodynamic speaker having a d-c resistance of 6.5 ohms to form a system that has a nominal 8 ohm impedance and radiates a substantially uniform power response as a function of frequency. This network coacts with the tweeter to produce an on-axis free-field pressure response that rises as a function of increasing frequency so that the system has a substantially uniform radiated power response as a function of frequency. In the common frequency range the 1 mh inductor shunted by the 9.1 ohm resistor produces the dip in woofer output.

It is within the principles of the invention to mount one or more tweeters on gimbals to permit energy to be directed upward or downward and to enable a loudspeaker system to be oriented with its length horizontally or vertically while still permitting energy to be reflected from sidewalls. While a ported structure is shown and preferred for efficiency reasons, it is within the principles of the invention to use a sealed cabinet.

Although the invention preferably uses reflections from sidewals when available, a system according to the invention may functin as a spatially extended source without using wall reflections. The invention achieves this effect by having at least two spaced drivers, such as a woofer and a tweeter, that operate over a common frequency range, and exhibit different transfer characteristics between the input terminal pair of the loudspeaker and the room into which the system radiates. A preferred way of achieving these differences is to use transducers having different characteristics, such as a woofer and a tweeter. The woofer such as 45 may be regarded as a first loudspeaker driver supported by the cabinet for radiating sound energy to the front over a first frequency range and having a first polar response, and the tweeter such as 43 may be regarded as a second loudspeaker driver supported by the cabinet for radiating sound energy to the front and side over a second frequency range mostly higher than the first frequency range and having a second directional polar response different from the first polar response.

If two spaced drivers with identical characteristics radiate the same sound, the ear perceives the sound as originating midway between the two. The brain is believed to act as a cross correlator that correlates the signal perceived by the left ear with the signal perceived by the right ear, producing an effective cross correlation signal characterized by spikes because of the coherence between the signals emitted by the like drivers. By causing the drivers to have dissimilar characteristics over a substantial common frequency range, there is no coherence between the signals emitted by the drivers with the result that there is no spike in the effective cross correlation response of the left and right ears. The sound perceived is then more nearly like that perceived by a listener in the concert hall because there is an absence of exact coherence between the sounds provided by the spaced instruments.

An actual commercial embodiment of the invention is the BOSE Model 301 loudspeaker system. The panels are typically made of ½" thick particle board with a density of 42–45 pounds. The top and bottom panels are typically 17" by 9¼". The front panel is typically 12" by 10", and the side panel facing the center of the room is typically 9¼" by 10". The angle between front panel 34 and corner panel 37 is substantially 135 degrees, and the diameter of port 38 is substantially 2½. Deflecting panel 42 is substantially 2¼" wide, 4 31/32" long along the front edge and substantially 15/32" less along the rear edge with its axis of rotation substantially 5/32" from the front edge.

An embodiment of the invention corresponding substantially to the embodiment of FIG. 1 includes a 10" woofer having a d-c resistance of 6 ohms having a depressed shelf response beginning at 700 Hz and tapering down to 3 kHz, a midrange driver or middler having a d-c resistance of 6.5 ohms having a response that begins at about 700 Hz to complement the woofer to about 3 kHz tapering down from 3 kHz to 10 kHz and a tweeter having a d-c resistance of 6.5 ohms that complements the woofer and middler from 1.2 kHz to 3 or 4 kHz and then extends to about 16 kHz. The woofer and middler thus overlap for more than two octaves, the middler and tweeter overlap for more than three octaves and the tweeter and woofer overlap for more than an octave. A suitable transition network for coaction with these drivers comprises connecting the woofer directly across the input terminals, connecting the series combination of a 13 ohm resistor, 5 mfd. capacitor and the driver across the input terminals and a 2 mfd. capacitor in series with the tweeter across the input terminals. Respective adjustable deflecting panels similar to panel 42 in FIG. 3 are adjacent to the middler and tweeter.

There has been described novel apparatus and techniques for reproducing sound with high quality perceived as emanating from a relatively broad source and that performs well in a wide variety of listening environments. Yet the structure is compact and relatively easy and inexpensive to fabricate. It is evident that those skilled in the art may now make numerous uses and modifications of and departures from the specfic embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system comprising, cabinet means for supporting loudspeaker drivers, first loudspeaker driver means supported by said cabinet for radiating sound energy to the front over a first frequency range and having a first polar response, second loudspeaker driver means supported by said cabinet for radiating sound energy over a second frequency range mostly higher than said first frequency range to the front and side for reflection first from a reflecting surface and then into the listening area along a path after a single reflection that intersects the first loudspeaker driver means axis at a point in said listening area and having a directional second polar response different from said first polar response, the angle between the axes of said first and second loudspeaker driver means being an acute angle.

an input terminal pair, and means for intercoupling said input terminal pair and said first and second loudspeaker driver means for providing spectral components in a common frequency range to said first and second loudspeaker driver means, said means for inercoupling coacting with said first and second loudspeaker driver means to comprise means for attenuating spectral components radiated by said first driver means above a first frequency at the high end of said common frequency range relative to spectral components applied thereto in said common frequency range and means for attenuating spectral components radiated by said second driver means below a second frequency at the low end of said common frequency range relative to spectral components applied thereto in said common frequency range so that the difference between the gain from said input terminal pair to the output of said first driver means and the gain from said input terminal pair to the output of said second driver means is substantially uniform over said common frequency range, said means for intercoupling coacting with said first and second loudspeaker driver means to comprise means for dissimilarly radiating from first and second locations defined by said first and second loudspeaker driver means respectively spectral components over said over said common frequency range to provide a spatially diffuse source, said common frequency range being at least half an octave, said loudspeaker system being free of other loudspeaker driver means which radiate energy having spectral components above said first frequency range primarily directly into the listening area.

2. A loudspeaker system in accordance with claim 1 wherein said common frequency rage is at least an octave.

3. A loudspeaker system in accordance with claim 1 wherein said means for intercoupling coacts with said first loudspeaker driver means and said second loudspeaker driver means to comprise means for establishing the radiated power response as a function of frequency of said loudspeaker system substantially uniform over the frequency range over which said first loudspeaker driver means and said second loudspeaker driver means radiate.

4. A loudspeaker system in accordance with claim 1 wherein said first loudspeaker driver means is supported in a front panel of said cabinet with its axis substantially perpendicular to said front panel and said second loudspeaker driver means is supported with its axis making an acute angle with the axis of said first loudspeaker driver means, said second loudspeaker driver means having a directional radiation characteristic directed predominantly within a solid angle centered about its axis.

5. A loudspeaker system in accordance with claim 1 wherein said means for intercoupling includes transition network means coacting therewith for establishing a second break frequency near the low end of said common frequency range and a first break frequency at the high end of said common frequency range.

said second break frequency being between 500 and 1000 Hz, said first break frequency being between 2 kHz and 3 kHz.

6. A loudspeaker system in accordance with claim 5 and further comprising, third loudspeaker driver means supported by said cabinet for radiating sound energy, means for intercoupling said input terminal pair and said second and third loudspeaker driver means for providing spectral components in a second common frequency range to said second and third loudspeaker driver means, said transition network means coacting therewith for establishing a third break frequency near the high end of said second common frequency range between 6 kHz and 9 kHz.

7. A loudspeaker system in accordance with claim 6 wherein said cabinet includes a front panel between left and right angled panels, said first loudspeaker driver means being supported on said front panel means, said second and third loudspeaker driver means being adjacent to respective ones of said angled panels.

8. A loudspeaker system in accordance with claim 5, wherein said first break frequency is substantially 3 kHz and said second break frequency is substantially 1 kHz.

9. A loudspeaker system in accordance with claim 1 wherein said second driver means is characterized by a directional radiation pattern having a maximum direction of radiation oriented along an axis directed both forward and sideward of said cabinet means, and means for selectively positioning said maximum of radiation between a front end position with said direction of radiation more forward than sideward and a side end position with said direction of radiation more sideward than forward.

10. A stereo loudspeaker system in a room having at least a front wall separating first and second side walls generally perpendicular thereto, comprising, means defining first and second enclosures each having top, bottom, rear, and front panels, woofer means on the front panel of each enclosure for radiating low audio frequency signals, tweeter means supported to the side and left of said woofer means in one of said enclosures and to the side and right of said woofer means in the other of said enclosures for directionally radiating high audio frequency signals, each of said tweeter means characterized by a directional radiation pattern having a maximum direction of radiation oriented along the tweeter axis directed both forward and sideward of the front panel which axis forms an acute angle with the woofer axis, said first enclosure being the mirror image of said second enclosure with the woofer means and tweeter means on each enclosure assymetrically arranged on each enclosure about a plane perpendicularly bisecting said front panel, said first and second enclosures being adjacent to said front wall and nearer to said first and second side walls, respectively, than to each other so that sound from each tweeter is directed toward an adjacent side wall.

11. A steror loudspeaker system comprising, means defining first and second enclosures each having top, bottom, rear and front panels, woofer means on the front panel of each enclosure for radiating low audio frequency signals, tweeter means supported to the side and left of said woofer means in one of said enclosures and to the side and right of said woofer means in the other of said enclosures for directionally radiating high audio frequency signals, each of said tweeter means characterized by a directional radiation pattern having a maximum direction of radiation oriented along the tweeter axis directed both forward and sideward of the front panel which axis forms an acute angle with the woofer axis, said first enclosure being the mirror image of said second enclosure and means for selectively positioning said maximum direction of radiation between a front end position with said direction of radiation more forward than sideward and a side end position with said direction of radiation more sideward than forward.

* * * * *